US009306374B2

(12) United States Patent
Nakayama et al.

(10) Patent No.: US 9,306,374 B2
(45) Date of Patent: Apr. 5, 2016

(54) SPARK PLUG

(71) Applicant: NGK SPARK PLUG CO., LTD., Nagoya-shi, Aichi (JP)

(72) Inventors: Katsutoshi Nakayama, Nagoya (JP); Tomokatsu Kashima, Kiyosu (JP); Tatsunori Yamada, Seto (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/419,313

(22) PCT Filed: Aug. 9, 2013

(86) PCT No.: PCT/JP2013/004817
§ 371 (c)(1),
(2) Date: Feb. 3, 2015

(87) PCT Pub. No.: WO2014/024501
PCT Pub. Date: Feb. 13, 2014

(65) Prior Publication Data

US 2015/0222096 A1 Aug. 6, 2015

(30) Foreign Application Priority Data

Aug. 9, 2012 (JP) ..... 2012-176828

(51) Int. Cl.
*H01T 13/20* (2006.01)
*H01T 13/32* (2006.01)
*H01T 13/39* (2006.01)

(52) U.S. Cl.
CPC ..... *H01T 13/32* (2013.01); *H01T 13/39* (2013.01)

(58) Field of Classification Search
CPC ..... H01T 1/00; H01T 1/20; H01T 1/22; H01T 13/00; H01T 13/28; H01T 13/02; H01T 13/12; H01T 13/20
USPC ..... 313/118, 141, 142, 143, 144
See application file for complete search history.

(56) References Cited

U.S. PATENT DOCUMENTS 4,439,707 A * 3/1984 Hattori ..... H01T 13/39 313/130
4,742,265 A 5/1988 Giachino et al. ..... 313/141
(Continued)

FOREIGN PATENT DOCUMENTS

JP S33-10768 (B) 12/1958
JP S48-31417 (U) 4/1973
(Continued)

OTHER PUBLICATIONS

International Search Report from corresponding International Patent Application No. PCT/JP2013/004817, dated Oct. 15, 2013 (English-language translation provided).
"Road Vehicles—M12 x 1,25 spark-plugs with flat seating and 14 mm bi-hexagon and their cylinder head housing." ISO 22977, First Edition Jul. 15, 2005.

*Primary Examiner* — Nimeshkumar Patel
*Assistant Examiner* — Kevin Quarterman
(74) *Attorney, Agent, or Firm* — Kusner & Jaffe

(57) ABSTRACT

A spark plug having a metal shell, center electrode and a ground electrode. The ground electrode includes an electrode base portion extending from a front end portion of the metal shell toward the front, a bent portion connected at one end thereof to a front end of the electrode base portion and an electrode distal end portion extending from the other end of the bent portion and forming a spark discharge gap with a center electrode. The ground electrode has a base material and a coating layer applied to the base material. The coating layer is formed on at least a front end face and an outer circumferential surface other than a center-electrode-side surface of the electrode distal end portion of the ground electrode. The base material of the ground electrode is exposed at least at a part of the electrode base portion.

11 Claims, 10 Drawing Sheets

(56) References Cited

U.S. PATENT DOCUMENTS

| | | | | |
|---|---|---|---|---|
| 2007/0188065 | A1* | 8/2007 | Ishinada | H01T 13/20 313/141 |
| 2007/0216275 | A1* | 9/2007 | Torii | H01T 13/20 131/141 |
| 2007/0236124 | A1 | 10/2007 | Lykowski et al. | 313/141 |
| 2011/0210659 | A1* | 9/2011 | Suzuki | H01T 13/32 313/141 |
| 2013/0069516 | A1* | 3/2013 | Sumoyama | C22C 5/04 313/141 |
| 2014/0117833 | A1* | 5/2014 | Kodama | H01T 13/20 313/141 |

FOREIGN PATENT DOCUMENTS

| | | | |
|---|---|---|---|
| JP | S60/41785 (A) | 3/1985 | H01T 13/39 |
| JP | S63138681 (A) | 6/1988 | H01T 13/39 |
| JP | H05114457 (A) | 5/1993 | H01T 13/20 |
| JP | H11514145 (A) | 11/1999 | H01T 13/20 |
| JP | 2006-236906 (A) | 9/2006 | H01T 13/20 |
| JP | 2009-533802 (A) | 9/2009 | C22C 19/03 |

* cited by examiner

SPARK PLUG

RELATED APPLICATIONS

This application is a National Stage of International Application No. PCT/JP2013/004817 filed Aug. 9, 2013, which claims the benefit of Japanese Patent Application No. 2012-176828 filed Aug. 9, 2012.

FIELD OF THE INVENTION

The present invention relates to a spark plug for use in an internal combustion engine etc.

BACKGROUND OF THE INVENTION

A spark plug is mounted on an internal combustion engine (sometimes just referred to as "engine") etc. and used to ignite an air-fuel mixture in a combustion chamber of the engine. In general, the spark plug includes an insulator having an axial hole formed in an axis direction, a center electrode inserted in a front side of the axial hole, a metal shell arranged on an outer circumference of the insulator and a ground electrode joined to a front end portion of the metal shell. The ground electrode is bent at a substantially middle position thereof such that a distal end portion of the ground electrode faces a front end portion of the center electrode so as to form a gap between the distal end portion of the ground electrode and the front end portion of the center electrode. With the application of a high voltage to the gap, the spark plug generates a spark discharge for ignition of the air-fuel mixture.

For improvement in the oxidation resistance of the ground electrode, there has recently been proposed a technique to cover a center-electrode-side gap-forming part (referred to as "discharge part") of the ground electrode with a protection layer of highly oxidation-resistant metal (see e.g. PCT International Application Publication No. JP-T-2009-533802 and PCT International Application Publication No. JP-T-H11-514145). In particular, it has been proposed in PCT International Application Publication No. JP-T-2009-533802 to cover the entire surface of the ground electrode with the protection layer.

During operation of the internal combustion engine, a part of the ground electrode located closer to a center side of the combustion chamber than the discharge part and protruding more from a front end of the metal shell reaches a particularly high temperature. Among the distal end portion of the ground electrode, a distal end face and an outer circumferential surface other than the center-electrode-side surface of the ground electrode become particularly high in temperature and tends to get corroded by oxidation. Thus, the oxidation resistance of the ground electrode may not be improved sufficiently even in the case where the protection layer is formed on the discharge part of the ground electrode.

In the case where the entire surface of the ground electrode is covered with the protection layer, by contrast, the ground electrode can achieve high oxidation resistance. However, the protection layer causes deterioration in thermal conductivity because the constitutional material of the protection layer contains additives such as chromium and aluminum for improvement in oxidation resistance. It is thus difficult to radiate heat of the ground electrode so that the heat radiation performance of the ground electrode becomes deteriorated in the case where the entire surface of the ground electrode is covered with the protection layer. As a result, there is a possibility of overheating of the ground electrode, which leads to pre-ignition by the action of heat from the ground electrode as well as wear resistance deterioration of the ground electrode.

The present invention has been made in view of the above circumstances. An advantage of the present invention is a spark plug in which a ground electrode can be assuredly prevented from overheating while securing sufficient improvement in oxidation resistance.

SUMMARY OF THE INVENTION

The configurations suitable for achieving the above object of the present invention will be described below. The specific functions and effects of these configurations will be also described as needed.

Configuration 1

In accordance with a first aspect of the present invention, there is provided a spark plug, comprising:

a cylindrical insulator having an axial hole formed therethrough in an axis direction of the spark plug;

a center electrode inserted in an front side of the axial hole;

a cylindrical metal shell arranged on an outer circumference of the insulator; and a ground electrode joined to a front end portion of the metal shell so as to form a gap between the ground electrode and the center electrode, the ground electrode including an electrode base portion extending from the front end portion of the metal shell toward the front in the axis direction; a curved bent portion connected at one end thereof to a front end of the electrode base portion; and an electrode distal end portion extending from the other end of the bent portion in a direction different from the direction of extension of the electrode base portion and forming the gap with the center electrode, wherein the ground electrode comprises a base material and a coating layer applied to the base material and made of a material having higher oxidation resistance than that of the base material so as to cover at least a distal end face and an outer circumferential surface other than a center-electrode-side surface of the electrode distal end portion; and wherein the base material of the ground electrode is exposed at least at a part of the electrode base portion.

According to configuration 1, the highly oxidation-resistant coating layer is formed on at least the distal end face and the outer circumferential surface other than the center-electrode-side surface of the electrode distal end portion of the ground electrode. This means the coating layer is formed on the part of the ground electrode that reaches a particularly high temperature during operation of an internal combustion engine etc. and has a fear of corrosion by oxidation under such high temperature conditions. It is therefore possible to effectively protect the ground electrode from corrosion by oxidation and sufficiently improve the oxidation resistance of the ground electrode.

Further, the base material of the ground electrode is exposed at least at the part of the electrode base portion that is relatively less likely to reach a high temperature and less likely to get corroded by oxidation, without being covered with the coating layer, according to configuration 1. This facilitates radiation of heat from the ground electrode so as to improve the heat radiation performance of the ground electrode while maintaining the high oxidation resistance of the ground electrode. It is therefore possible to assuredly prevent overheating of the ground electrode.

It is also possible according to configuration 1 to attain reduction in processing time and production cost for improvement in productivity during the process of formation of the coating layer as the coating layer does not need to be formed on at least the part of the electrode base portion.

The coating layer may be, or may not be, formed on the center-electrode-side outer circumferential surface of the ground electrode. The coating layer, even when formed on the center-electrode-side outer circumferential surface of the ground electrode, tends to become shortly separated by spark discharges and makes almost no contribution to oxidation resistance improvement. For this reason, it is preferable in terms of productivity that the coating layer is not formed on the center-electrode-side surface of the ground electrode.

Configuration 2

In accordance with a second aspect of the present invention, there is provided a spark plug according to configuration 1, wherein the base material of the ground electrode is exposed at the entire outer surface of the electrode base portion.

According to configuration 2, the base material of the ground electrode is exposed at the entire outer surface of the electrode base portion without the electrode base portion being covered with the coating layer. It is therefore possible to further improve the heat radiation performance of the ground electrode and more assuredly prevent overheating of the ground electrode.

Configuration 3

In accordance with a third aspect of the present invention, there is provided a spark plug according to configuration 1 or 2, wherein the coating layer is formed only on the electrode distal end portion; and wherein the base material of the ground electrode is exposed at the bent portion.

According to configuration 3, the coating layer is formed only on the distal end face etc. of the electrode distal end portion that is likely to reach a particularly high temperature and likely to get corroded by oxidation; whereas the base material of the ground electrode is exposed at the bent portion. This allows further improvement in the heat radiation performance of the ground electrode while securing the high oxidation resistance of the ground electrode. It is therefore possible to further improve the overheating prevention effect of the ground electrode.

It is also possible according to configuration 3 to more effectively reduce the processing time etc. for further improvement in productivity during the process of formation of the coating layer as the coating layer does not need to be formed on the bent portion.

Configuration 4

In accordance with a fourth aspect of the present invention, there is provided a spark plug according to any one of configurations 1 to 3, wherein the base material of the ground electrode is a metal material containing 90 mass % or more of nickel (Ni).

According to configuration 4, the metal material containing 90 mass % or more of Ni is used as the base material of the ground electrode. It is therefore possible to increase the thermal conductivity of the ground electrode and further improve the overheating prevention effect (wear resistance) of the ground electrode.

Because of the relatively low oxidation resistance of Ni, there arises a larger fear that that the oxidation resistance of the ground electrode may be deteriorated in the case where a metal material containing a large amount of Ni is used as the base material of the ground electrode as in configuration 4. However, the ground electrode can achieve high oxidation resistance when the coating layer is formed according to configuration 1 etc. In other words, the adoption of configuration 1 etc. is particularly significant when the metal material containing 90 mass % or more of Ni is used as the base material of the ground electrode so as to further improve the overheating prevention effect (wear resistance) of the ground electrode.

Configuration 5

In accordance with a fifth aspect of the present invention, there is provided a spark plug according to any one of configurations 1 to 4, wherein the coating layer has a thickness of 5 to 60 μm.

According to configuration 5, the thickness of the coating layer is set to 5 μm or larger. It is therefore possible to effectively prevent contact of oxygen with the ground electrode for improvement in oxidation resistance.

On the other hand, according to configuration 5, the thickness of the coating layer is set to 60 μm or smaller. This makes it easier to radiate heat from the part of the ground electrode covered with the coating layer so as to further improve the heat radiation performance of the ground electrode. It is therefore possible to more assuredly prevent overheating of the ground electrode.

Configuration 6

In accordance with a sixth aspect of the present invention, there is provided a spark plug according to any one of configurations 1 to 5, wherein the coating layer is formed only on the electrode distal end portion.

Alternatively, the coating layer is formed on the electrode distal end portion and the bent portion in such a manner that a minimum thickness of the coating layer on the electrode distal end portion is larger than a minimum thickness of the coating layer on the bent portion.

According to configuration 6, the minimum thickness of the coating layer on the electrode distal end portion is set larger than the minimum thickness of the coating layer on the bent portion. (In the case where the coating layer is formed only on the electrode distal end portion, the minimum thickness of the coating layer on the bent portion is zero.) This means that the thick coating layer is formed on the distal end face etc. of the electrode distal end portion that is likely to reach a particularly high temperature and has a fear of corrosion by oxidation. It is therefore possible to more effectively prevent contact of oxygen with the distal end face etc. of the electrode distal end portion for effective improvement in oxidation resistance.

Configuration 7

In accordance with a seventh aspect of the present invention, there is provided a spark plug according to any one of configurations 1 to 6, wherein a minimum thickness of the coating layer on the distal end face of the electrode distal end portion is larger than a minimum thickness of the coating layer on the outer circumferential surface other than the center-electrode-side surface of the electrode distal end portion.

As mentioned above, the distal end face and the outer circumferential surface other than the center-electrode-side surface of the electrode distal end portion are likely to reach a high temperature and likely to get corroded by oxidation. Among others, it is especially likely that the distal end face of the electrode distal end portion will become high in temperature and get corroded by oxidation because the distal end face is located farthest apart from the metal shell and is difficult to radiate heat to the metal shell.

In view of such a fact, the minimum thickness of the coating layer on the distal end face of the electrode distal end portion is set larger than the minimum thickness of the coating layer on the outer circumferential surface other than the center-electrode-side surface of the electrode distal end portion according to configuration 7. It is therefore possible to very effectively prevent contact of oxygen with the distal end face for more effective improvement in oxidation resistance.

Configuration 8

In accordance with an eighth aspect of the present invention, there is provided a spark plug according to any one of configurations 1 to 7, wherein the coating layer is formed only on the distal end face and the outer circumferential surface other than the center-electrode-side surface of the electrode distal end portion.

Alternatively, the coating layer is formed on the entire outer surface of the electrode distal end portion in such a manner that a minimum thickness of the coating layer on the center-electrode-side surface of the electrode distal end portion is smaller than a minimum thickness of the coating layer on the distal end face and the outer circumferential surface other than the center-electrode-side surface of the electrode distal end portion.

As mentioned above, the coating layer formed on the center-electrode-side surface of the electrode distal end portion (which forms the gap with the center electrode) tends to become separated by spark discharges. Further, the coating layer is generally lower in wear resistance than the base material of the ground electrode. In the case where the thick coating layer is formed on the center-electrode-side surface of the electrode distal end portion (which forms the gap with the center electrode), there arises a fear that the size of the gap significantly increases in a short time due to separation of the coating layer or sudden wearing of the coating layer by spark discharges. If the size of the gap increases, the voltage required for generation of spark discharges (i.e. discharge voltage) becomes increased. This results in sudden wearing of the ground electrode (coating layer) and the center electrode.

In the case where the coating layer is not formed on the center-electrode-side surface of the electrode distal end portion as in configuration 8, however, the gap can be assuredly prevented from increasing in size.

Even in the case where the coating layer is formed on the center-electrode-side surface of the electrode distal end portion, the minimum thickness of the coating layer on the center-electrode-side surface of the electrode distal end portion is set smaller than the minimum thickness of the coating layer on the distal end face and the outer circumferential surface other than the center-electrode-side surface of the electrode distal end portion according to configuration 8. The gap can be thus assuredly prevented from increasing in size even in the event of separation of the coating layer or sudden wearing of the coating layer by spark discharges. It is therefore possible to retard increase of the discharge voltage and effectively prevent sudden wearing of the ground electrode and the like.

Configuration 9

In accordance with a ninth aspect of the present invention, there is provided a spark plug according to any one of configurations 1 to 8, wherein the material of the coating layer is a material containing Ni, cobalt (Co) and chromium (Cr).

According to configuration 9, the material of the coating layer contains Cr, which has high oxidation resistance. It is therefore possible to assuredly improve the oxidation resistance of the ground electrode.

Configuration 10

In accordance with a tenth aspect of the present invention, there is provided a spark plug according to configuration 9, wherein the material of the coating layer further contains yttrium (Y) and aluminum (Al).

According to configuration 10, the material of the coating layer contains not only Cr but also Y and Al, each of which has high oxidation resistance. It is therefore possible to more assuredly improve the oxidation resistance of the ground electrode.

Configuration 11

In accordance with an eleventh aspect of the present invention, there is provided a spark plug according to any one of configurations 1 to 10, wherein the coating layer is formed by high velocity oxygen fuel (HVOF) spraying, high velocity air fuel (HVAF) spraying, plasma spraying, cold spraying or aerosol deposition.

According to configuration 11, the ground electrode can be prevented from temperature rise and thereby assuredly protected from damage by heat during the formation of the coating layer. In addition, the peeling resistance of the coating layer can be improved as the adhesion of the coating layer to the ground electrode becomes increased by the damage protection of the ground electrode. It is therefore maintain the high oxidation resistance of the ground electrode over a long period of time.

DETAILED DESCRIPTION OF THE PREFERRED EMBODIMENTS

Figure 1:
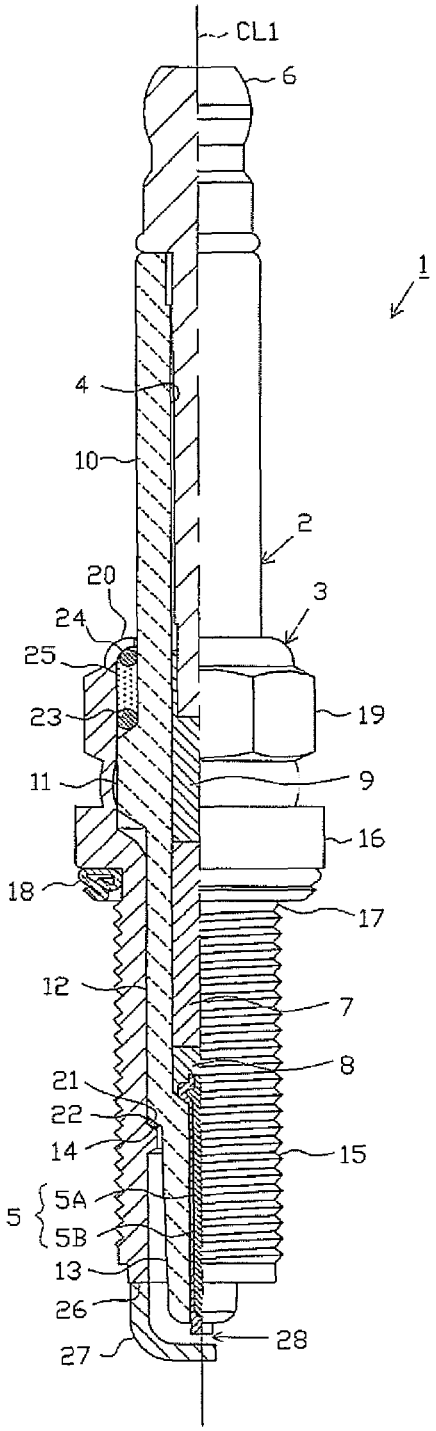
FIG. 1 is a partially cutaway elevation view of a spark plug according to one embodiment of the present invention.

Hereinafter, one exemplary embodiment of the present invention will be described below with reference to the drawings. FIG. 1 is an elevation view, partially in section, of a spark plug 1 according to one exemplary embodiment of the present invention. It is herein noted that the direction of an axis CL1 of the spark plug 1 corresponds to the vertical direction of FIG. 1 where the front and rear sides of the spark plug 1 are shown on the bottom and top sides of FIG. 1, respectively.

The spark plug 1 includes a ceramic insulator 2 as a cylindrical insulator and a cylindrical metal cell 3 holding therein the ceramic insulator 2.

The ceramic insulator 2 is made of sintered alumina as is generally known and has an outer shape including a rear body portion 10 located on a rear side thereof, a large-diameter portion 11 located front of the rear body portion 10 and protruding radially outwardly, a middle body portion 12 located front of the large-diameter portion 11 and made smaller in diameter than the large-diameter portion 11 and a leg portion 13 located front of the middle body portion 12 and made smaller in diameter than the middle body portion 12. The large-diameter portion 11, the middle body portion 12 and major part of the leg portion 13 of the ceramic insulator 2 are accommodated in the metal shell 3. The ceramic insulator 2 also has a step portion 14 located between the middle body portion 12 and the leg portion 13 so as to retain the ceramic insulator 2 in the metal shell 3 by means of the step portion 14.

Further, an axial hole 4 is formed through the ceramic insulator 2 in the direction of the axis CL1. A center electrode 5 is inserted and fixed in a front side of the axial hole 4. In the present embodiment, the center electrode 5 has an inner layer 5A made of a highly thermal-conductive metal material (such as copper, copper alloy or pure nickel (Ni)) and an outer layer 5B made of a Ni-based alloy. The center electrode 5 is formed as a whole into a rod shape (cylindrical column shape) and held in the ceramic insulator 2 with a front end portion of the center electrode 5 protruding from a front end of the ceramic insulator 2.

A terminal electrode 6 is inserted and fixed in a rear side of the axial hole 4 with a rear end portion of the terminal electrode 6 protruding from a rear end of the ceramic insulator 2.

A cylindrical column-shaped resistive element 7 is disposed between the center electrode 5 and the terminal electrode 6 within the axial hole 4 and is electrically connected at opposite ends thereof to the center electrode 5 and the terminal electrode 6 through conductive glass seal layers 8 and 9, respectively.

The metal shell 3 is made of a metal material such as low carbon steel in a cylindrical shape. The metal shell 3 has, on an outer circumferential surface thereof, a thread portion (male thread portion) 15 adapted for mounting the spark plug 1 onto a combustion apparatus such as an internal combustion engine or a fuel cell processing device and a seat portion 16 located rear of the thread portion 15 and protruding radially outwardly. A ring-shaped gasket 18 is fitted around a thread neck 17 on a rear end of the thread portion 15. The metal shell 3 also has, on a rear end side thereof, a tool engagement portion 19 formed into a hexagonal cross-sectional shape for engagement with a tool such as wrench for mounting the spark plug 1 onto the combustion apparatus and a crimped portion 20 bent radially inwardly.

The metal shell 3 also has a tapered step portion 21 formed on an inner circumferential surface thereof so as to hold thereon the ceramic insulator 2. The ceramic insulator 2 is inserted in the metal shell 3 from the rear toward the front and fixed in the metal shell 3 by crimping an open rear end portion of the metal shell 3 radially inwardly, with the step portion 14 of the ceramic insulator 2 retained on the step portion 21 of the metal shell 3, and thereby forming the crimped portion 20. An annular plate packing 22 is disposed between the step portions 14 and 21 so as to maintain the gas tightness of the combustion chamber and prevent the leakage of fuel gas to the outside through a space between the inner circumferential surface of the metal shell 3 and the leg portion 13 of the ceramic insulator 2 exposed to the combustion chamber of the combustion apparatus.

In order to secure more complete seal by crimping, annular ring members 23 and 24 are disposed between the metal shell 3 and the ceramic insulator 2 within the rear end portion of the metal shell 3; and the space between the ring members 23 and 34 is filled with a powder of talc 25. Namely, the metal shell 3 holds therein the ceramic insulator 2 via the plate packing 22, the ring members 23 and 24 and the talc 25.

Figure 2A:
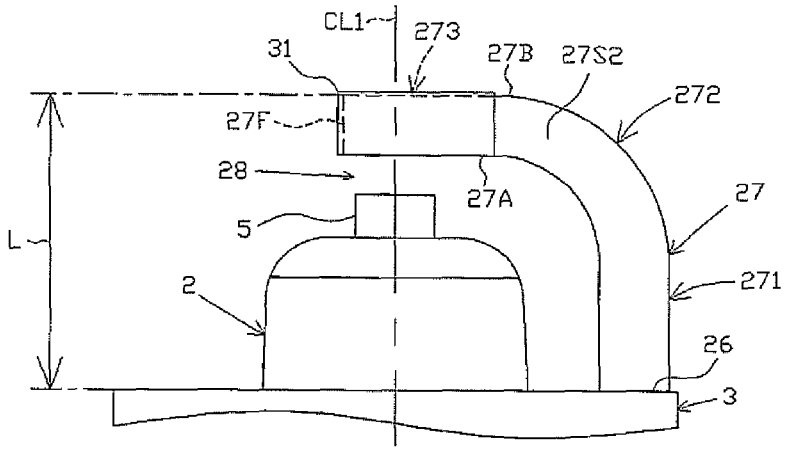
FIGS. 2(*a*) and 2(*b*) are an enlarged elevation view and a partially cutaway elevation view of a front end side of the spark plug, respectively.
Figure 2B:
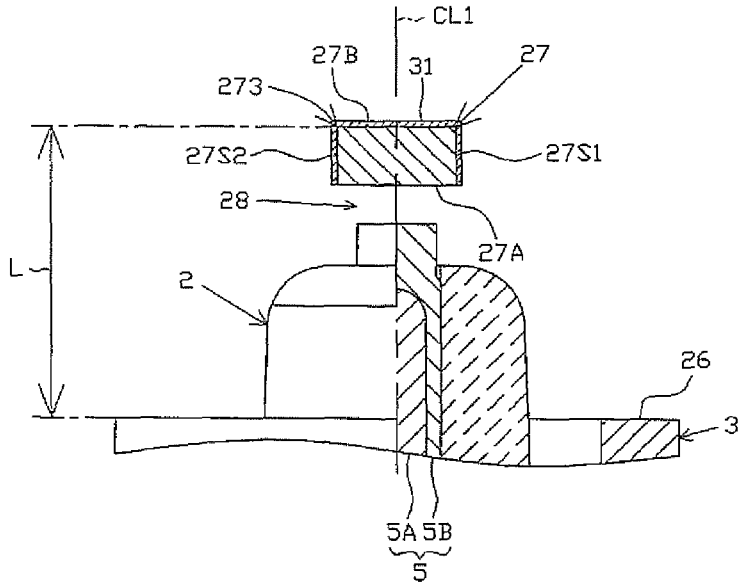

A ground electrode 27 is made of a metal material containing 90 mass % or more of Ni in a rectangular cross-sectional shape and joined to a front end portion 26 of the metal shell 3 as shown in FIGS. 2(*a*) and (*b*). The ground electrode 27 is bent at a substantially middle position thereof and is thereby provided with an electrode base portion 271, a bent portion 272 and an electrode distal end portion 273.

The electrode base portion 271 is formed into a straight rod shape and joined at a rear end thereof to the front end portion 26 of the metal shell 3 so as to extend toward the front in the direction of the axis CL1. The bent portion 272 is formed into a curved shape (bent shape) and connected at one end thereof to a front end of the electrode base portion 271. The electrode distal end portion 273 is formed into a straight rod shape so as to extend from the other end of the bent portion 272 in a direction different from the direction of extension of the electrode base portion 271 (in the present embodiment, in a direction perpendicular to the axis CL1). There is formed a spark discharge gap 28 as a gap between the electrode distal end portion 273 and the front end portion of the center electrode 5 such that a spark discharge is generated in the spark discharge gap 28 substantially along the direction of the axis CL1.

For improvement in ignition performance, the protrusion length L of the ground electrode 27 relative to the front end of the metal shell 3 in the direction of the axis CL1 is set to a relatively large value (e.g. 7 mm or larger). It is however likely that the distal end portion of the ground electrode 27 will reach a higher temperature in the case where the protrusion length L is set relatively large. There thus arises a fear that the distal end portion of the ground electrode 27 may be corroded by oxidation under such high temperature conditions.

In view of the above problem, a highly oxidation-resistant coating layer 31 is applied to a base material of the ground electrode 27 so as to cover at least a distal end face 27F and an outer circumferential surface other than a center-electrode 5-side facing surface 27A of the electrode distal end portion 273 in the present embodiment. (It is herein noted that, in FIG. 2 etc., the coating layer 31 is shown with a larger thickness than actual for illustration purposes.) More specifically, the coating layer 31 is formed on the distal end face 27F, back surface 27B opposite to the facing surface 27A and both side surfaces 27S1 and 27S2 adjacent to the facing surface 27A and the back surface 27B. In the present embodiment, the coating layer 31 is formed only on the electrode distal end portion 273; and the base material of the ground electrode 27 is exposed at the bent portion 272.

The coating layer 31 is made of a metal material containing Ni, cobalt (Co) and chromium (Cr) and having higher oxidation resistance than the base material (i.e. metal material containing 90 mass % or more of Ni) of the ground electrode 27. Yttrium (Y) and aluminum (Al) may be added into the metal material of the coating layer 31.

Herein, the superiority or inferiority of the oxidation resistance can be judged by the following procedure. The metal material is applied as a coating layer on a surface of a piece of a predetermined metal (such as Ni-based alloy). The resulting metal piece is subjected to repeated cycles of heating and cooling. It is judged that the oxidation resistance of the metal material is higher than the oxidation resistance of the base material of the ground electrode 27 when the thickness of an oxidation film formed on the metal piece during the repeated cycles of heating and cooling is smaller in the case where the coating layer is of the above metal material than in the case where the coating layer is of the same metal as the base material of the ground electrode 27. The heating and cooling is performed about 3000 cycles assuming the operation of heating the metal piece at 1000° C. for 2 minutes and then cooling the metal piece for 1 minute as one cycle.

The oxidation resistance of the ground electrode 27 can be improved by the formation of the coating layer 31 as mentioned above. However, the thermal conductivity of the coating layer 31 is lower than that of the base material of the ground electrode 27 because the protection layer 31 contains additives such as Cr and Al in the coating layer 31. The formation of the coating layer 31 may thus lead to deterioration in the heat radiation performance of the ground electrode 27. Due to such deteriorated heat radiation performance in combination with the relatively large protrusion length L, there arises a fear that the ground electrode 27 (in particular, the distal end portion of the ground electrode 27) may be overheated.

In view of the above problem, the base material of the ground electrode 27 is exposed at least at a part of the electrode base portion 271 without being covered with the coating layer 31 in the present embodiment. This means that the coating layer 31 is not intentionally formed on at least the part of the electrode base portion 271 that is easy to radiate heat to the metal shell 3 and is relatively less likely to reach a high temperature (less likely to get corroded by oxidation) such that the base material of the ground electrode 27 is exposed at such a part of the electrode base portion 271. It is thus possible to improve the heat radiation performance of the ground electrode 27. In particular, the base material of the ground electrode 27 is exposed at the entire outer surfaces of the electrode base portion 271 and the bent portion 272 as the coating layer 31 is formed only on the electrode distal end portion 273 as mentioned above in the present embodiment. This allows significant improvement in the heat radiation performance of the ground electrode 27.

Further, the coating layer 31 is formed with a thickness of 5 to 60 μm in the present embodiment.

Figure 3:
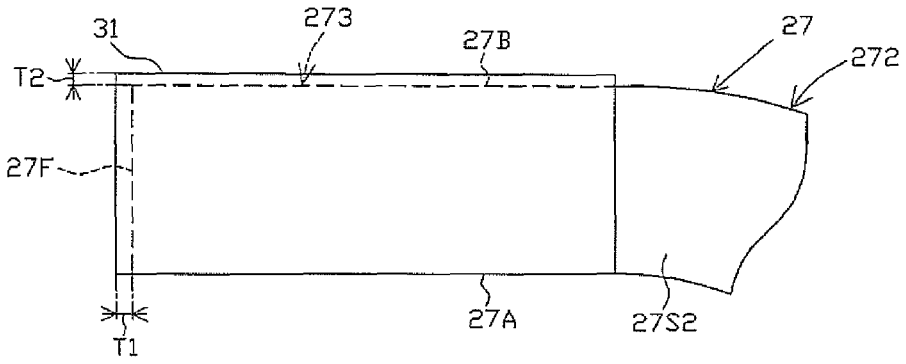
FIG. 3 is an enlarged elevation view showing the thickness of a coating layer on a spark plug of the spark plug.

Among the coating layer 31 on the electrode distal end portion 273, a minimum thickness T1 of the coating layer 31 on the distal end face 27F is set larger than a minimum thickness T2 of the coating layer 31 on the back surface 27B and the side surfaces 27S1 and 27S2 as shown in FIG. 3. This means the distal end face 27F, which is difficult to radiate heat to the metal shell 3 and is likely to reach the highest temperature (i.e. most likely to oxidize), is covered with the particularly thick coating layer 31.

In the present embodiment, the coating layer 31 is formed by high velocity oxygen fuel (HVOF) spraying, high velocity air fuel (HVAF) spraying, plasma spraying, cold spraying or aerosol deposition, i.e., by a technique that does not cause temperature rise of the ground electrode 27 during the formation of the coating layer 31.

Figure 4:
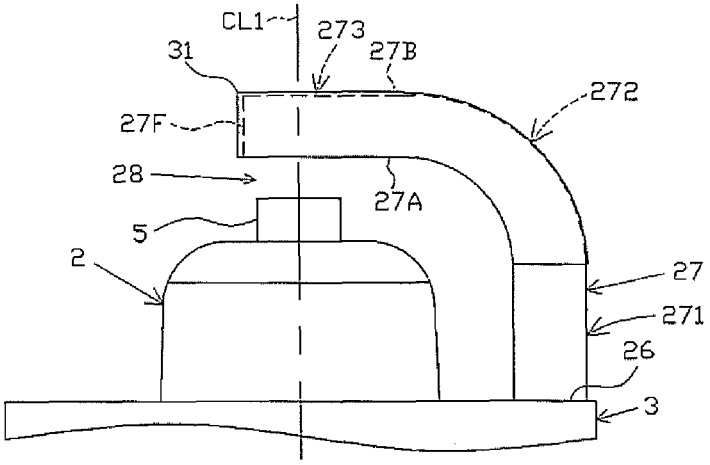
FIG. 4 is an enlarged elevation view showing another example of the coating layer on the ground electrode of the spark plug.
Figure 5:
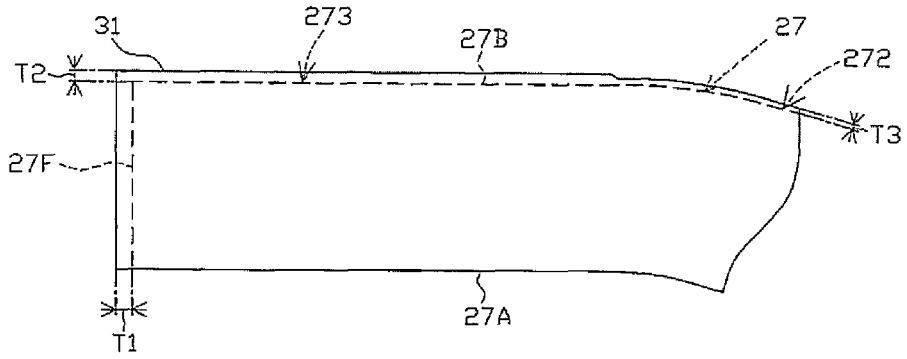
FIG. 5 is an enlarged elevation view showing the thickness of the another example of the coating layer.

The coating layer 31 is not necessarily formed only on the electrode distal end portion 273. As shown in FIG. 4, the coating layer 31 may be formed on the bent portion 272 and the electrode distal end portion 273. In such a case, it is preferable that the minimum thickness T2 of the coating layer 31 on the electrode distal end portion 273 is set larger than a minimum thickness T3 of the coating layer 31 on the bent portion 272 as shown in FIG. 5. This means the distal end face 27F and the back surface 27B of the electrode distal end portion 273, which are difficult to transfer heat to the metal shell 3 and are likely to reach a high temperature (i.e. likely to oxidize), are preferably covered with the particularly thick coating layer 31. This allows improvement in oxidation resistance as the distal end face 27F and the back surface 27B etc. can be more assuredly prevented from contact with oxygen.

As described above, the highly oxidation-resistant coating layer 31 is formed on the distal end face 27F, the back surface 27B and the side surfaces 27S 1 and 27S2 of the electrode distal end portion 273 in the present embodiment. It is thus possible to effectively protect the ground electrode 27 from corrosion by oxidation and sufficiently improve the oxidation resistance of the ground electrode 27.

On the other hand, the coating layer 31 is not intentionally formed on the entire outer surfaces of the electrode base portion 271 and the bent portion 272, which are less likely to reach a high temperature and less likely to get corroded by oxidation, such that the base material of the ground electrode 27 is exposed at the entire outer surfaces of the electrode base portion 271 and the bent portion 272 in the present embodiment. This facilitates radiation of heat from the ground electrode 27 so as to significantly improve the heat radiation performance of the ground electrode 27 while maintaining the high oxidation resistance of the ground electrode 27. It is thus possible to very effectively prevent overheating of the ground electrode 27.

It is also possible to attain reductions in processing time and production cost for improvement in productivity during the process of formation of the coating layer 31 as the coating layer 31 does not need to be formed on the electrode base portion 271 and the bent portion 272.

The metal material containing 90 mass % or more of Ni is used as the base material of the ground electrode 27. It is possible by the use of such a base material to increase the thermal conductivity of the ground electrode 27 and further improve the overheating prevention effect (wear resistance) of the ground electrode 27.

Although Ni is relatively low in oxidation resistance, the ground electrode 27 can achieve high oxidation resistance with the formation of the coating layer 31. In other words, the formation of the coating layer 31 is particularly significant when the metal material containing 90 mass % or more of Ni is used as the base material of the ground electrode 27 so as to further improve the overheating prevention effect (wear resistance) of the ground electrode 27.

Further, the minimum thickness T1 of the coating layer 31 on the distal end face 27F is set larger than the minimum thickness T2 of the coating layer 31 on the back surface 27B and the side surfaces 27S 1 and 27S2. It is thus possible to very effectively prevent contact of oxygen with the distal end face 27F, which is especially likely to reach a high temperature, for effective improvement in oxidation resistance.

As the coating layer 31 is not formed on the facing surface 27A of the electrode distal end portion 273, the spark discharge gap 28 can be assuredly prevented from significantly increasing in size by spark discharges. It is thus possible to retard increase of the discharge voltage and effectively prevent sudden wearing of the ground electrode 27 and the center electrode 5.

The material of the coating layer 31 contains Cr, which has high oxidation resistance. It is thus possible to assuredly improve the oxidation resistance of the ground electrode 27. The oxidation resistance of the ground electrode 27 can be further improved by the addition of Y and Al to the material of the coating layer 31.

As the coating layer 31 is formed by high velocity oxygen fuel (HVOF) spraying, high velocity air fuel (HVAF) spraying, plasma spraying, cold spraying or aerosol deposition, the ground electrode 27 can be prevented from temperature rise and assuredly protected from damage by heat during the formation of the coating layer. In addition, the peeling resistance of the coating layer 31 can be improved as the adhesion of the coating layer 31 to the ground electrode 27 becomes increased by the damage protection of the ground electrode 27. It is thus maintain the high oxidation resistance of the ground electrode 27 over a long period of time.

The following tests were conducted in order to verify the effects of the above embodiment. Spark plug samples of sample type 1 (as Comparative Examples) and sample type 2(as Examples) were first prepared, each having a ground electrode formed with a protrusion length L of 7.6 mm or 11.6 mm. In the spark plug samples of sample type 1, a coating layer was applied to the entire surface of the ground electrode. In the spark plug samples of sample type 2, a coating layer was applied only to an electrode distal end portion and a bent portion of the ground electrode such that a base material was exposed at an electrode base portion of the ground electrode. The thus-obtained spark plug samples of both sample types were subjected to temperature measurement test during heating. The procedure of the temperature measurement test is as follows. A spark plug sample (as a reference sample) was prepared having a ground electrode whose base material was exposed at its entire surface without being covered with a coating layer. A distal end portion of the ground electrode of the reference spark plug sample was heated with a predetermined burner in such a manner as to attain heating conditions under which the temperature of the ground electrode at 1 mm from a distal end of the ground electrode was set to 900° C. Using the same burner, a distal end portion of each of the spark plug samples of sample types 1 and 2 was heated under the above heating conditions. In this state, the temperature of the ground electrode at 1 mm from a distal end of the ground electrode was measured. The lower the measured temperature, the higher the heat radiation performance of the ground electrode and the higher the overheating prevention effect of the ground electrode.

Figure 6:
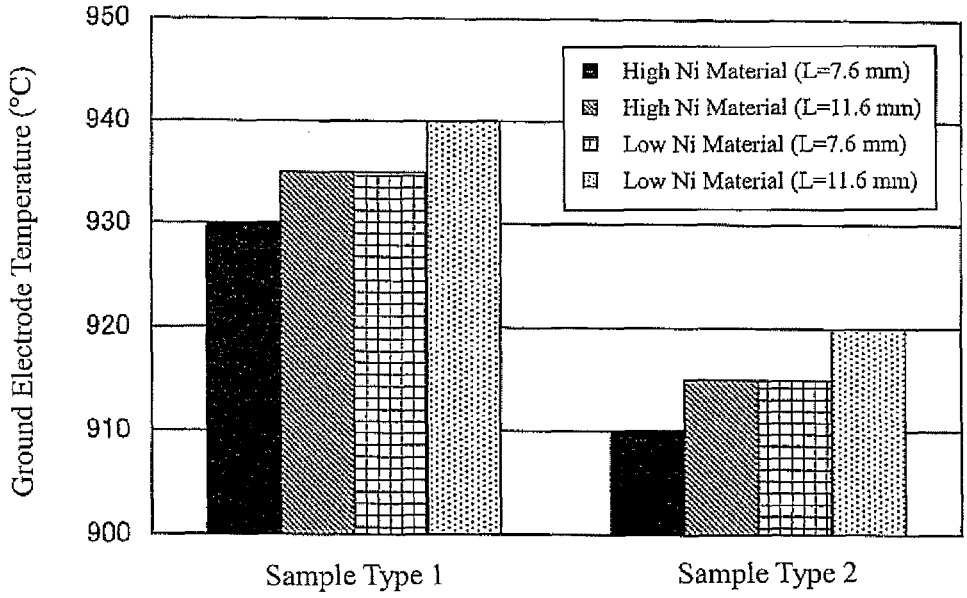
FIG. 6 is a graph showing the results of temperature measurement tests during heating of spark plug samples of sample type 1 in which the coating layer is applied to the entire surface of the ground electrode and of sample type 2 in which the coating layer is applied only to an electrode distal end portion and a bent portion of the ground electrode.

FIG. 6 shows the results of the temperature measurement test during heating of the spark plug samples of sample types 1 and 2. The ground electrodes herein used were of a metal material having a Ni content of 90 mass % or more (referred to as "high-Ni material") or a metal material containing Ni as a main component but having a Ni content of less than 90 mass % (referred to as "low-Ni material"). In FIG. 6, the test results of the spark plug samples in which the ground electrode was formed of high-Ni material with a protrusion length L of 7.6 mm are indicated with a black color; the test results of the spark plug samples in which the ground electrode was formed of high-Ni material with a protrusion length L of 11.6 mm are indicated with a shaded pattern; the test results of the spark plug samples in which the ground electrode was formed of low-Ni material with a protrusion length L of 7.6 mm are indicated with a grid pattern; and the test results of the spark plug samples in which the ground electrode was formed of low-Ni material with a protrusion length L of 11.6 mm are indicated with a dot pattern.

In each sample, the coating layer was of a metal material containing Ni, Co, Cr, Al and Y; the size of the spark discharge gap was set to 1.1 mm; and the width and thickness of the ground electrode was set to 2.8 mm and 1.5 mm, respectively. (The size of the ground electrode, the constitutional material of the coating layer and the size of the spark discharge gap were the same as above in the after-mentioned tests.) Further, the thickness of the coating layer was set to 20 μm in each sample.

As seen from FIG. 6, each of the spark plug samples of sample type 2 in which the base material of the ground electrode was exposed at the electrode base portion showed a significant decrease in the temperature of the ground electrode during heating as compared to the spark plug samples of sample type 1 in which the coating layer was formed on the entire surface of the ground electrode. The reason for this is assumed that heat of the ground electrode was efficiently radiated at the electrode base portion.

It has been confirmed by the above test results that, for the purpose of effectively protecting the distal end portion of the ground electrode, which is especially likely to reach a high temperature, from corrosion by oxidation and assuredly preventing overheating of the ground electrode, it is preferable to form the coating layer on at least the electrode distal end portion and allow the base material of the ground electrode to be exposed at least at the part of the electrode base portion.

Figure 7:
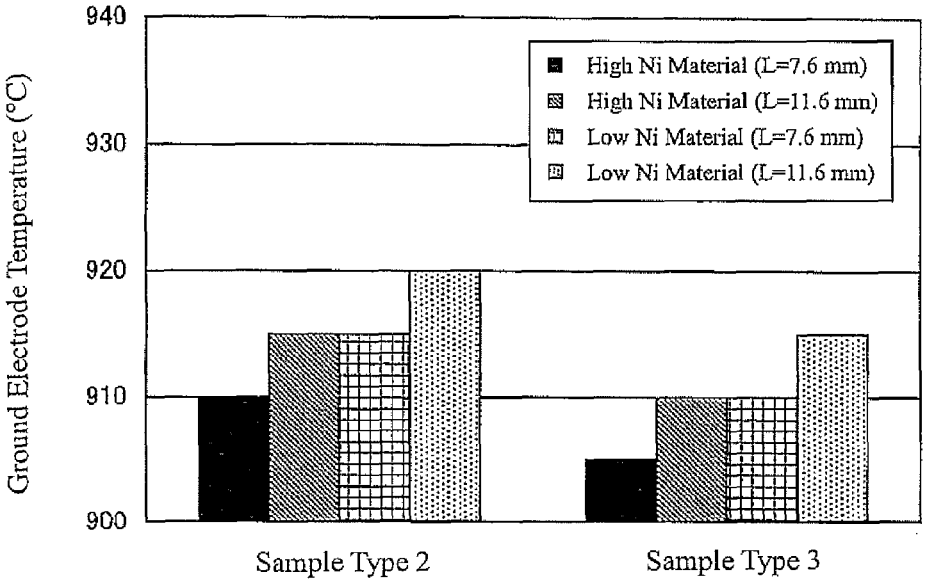
FIG. 7 is a graph showing the results of temperature measurement tests during heating of spark plug samples of sample type 2 in which the coating layer is applied only to an electrode distal end portion and a bent portion of the ground electrode and of sample type 3 in which the coating layer is applied only to an electrode distal end portion of the ground electrode.

Next, spark plug samples of sample type 3 were prepared, each having a ground electrode formed with a protrusion length L of 7.6 mm or 11.6 mm. In the spark plug samples of sample type 3, a coating layer was applied only to an electrode distal end portion of the ground electrode such that a base material was exposed at a bent portion and an electrode base portion of the ground electrode. The thus-obtained spark plug samples were subjected to temperature measurement test during heating in the same manner as above. FIG. 7 shows the results of the temperature measurement test during heating of the spark plug samples of sample type 3 together with those of the spark plug samples of sample type 2.

As seen from FIG. 7, each of the spark plug samples of sample type 3 in which the base material of the ground electrode was exposed at the electrode base portion and the bent portion showed a more significant decrease in the temperature of the ground electrode during heating. The reason for this is assumed that heat of the ground electrode was more efficiently radiated at the electrode base portion.

It has been confirmed by the above test results that it is more preferable to form the coating layer only on the electrode distal end portion and allow the base material of the ground electrode to be exposed at the bent portion and the electrode base portion for the purpose of further improving the overheating prevention effect of the ground electrode.

Figure 8:
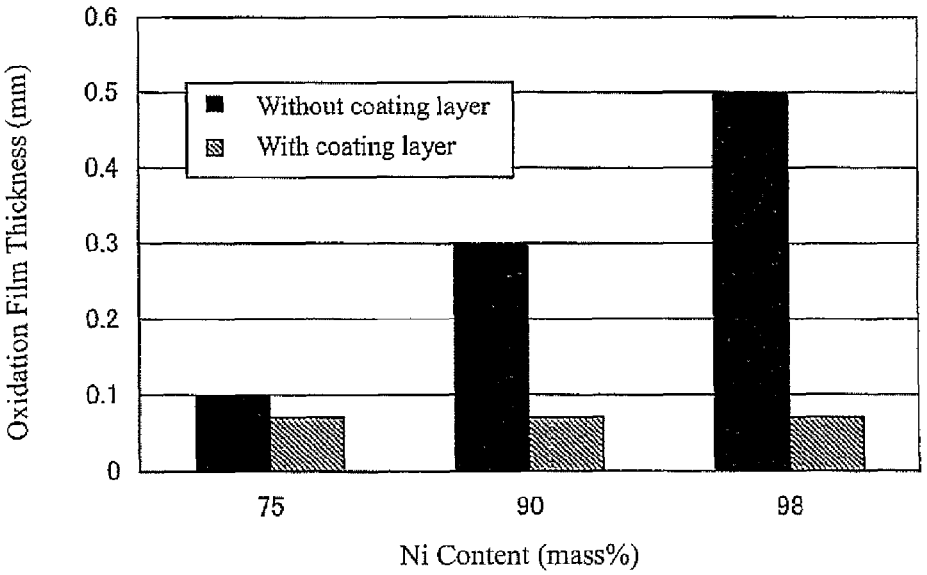
FIG. 8 is a graph showing the results of desk burner tests of spark plug samples prepared by varying the content of Ni in a base material of the ground electrode.

Subsequently, spark plug samples (with coating layers) were prepared, each having a ground electrode made using a metal material having a Ni content of 75 mass %, 90 mass % or 98 mass % as a base material. In each of these samples, the coating layer was applied only to an electrode distal end portion and a bent portion of the ground electrode. Spark plug samples (without coating layers) were also prepared, each having a ground electrode made using a metal material having a Ni content of 75 mass %, 90 mass % or 98 mass % as a base material. In each of these samples, no coating layer was applied to the ground electrode. The thus-obtained spark plug samples were subjected to desk burner test. The procedure of the desk burner test is as follows. Each of the spark plug samples was subjected to 3000 cycles of heating and cooling assuming the operation of heating the distal end portion of the ground electrode at 1000° C. for 2 minutes and then cooling the ground electrode for 1 minute as one cycle. After the completion of 3000 cycles of heating and cooling, the thickness of an oxidation film formed on a surface of the ground electrode was measured by observing a cross section of the distal end portion of the ground electrode. FIG. 8 shows the results of the desk burner test of the spark plug samples. In FIG. 8, the test results of the spark plug samples with the coating layers are indicated with a black color; and the test results of the spark plug samples without the coating layers are indicated with a shaded pattern.

The protrusion length L of the ground electrode was set to 7.6 mm in each sample. In each sample with the coating layer, the thickness of the coating layer was set to 15 μm.

As seen from FIG. 8, among the spark plug samples in which the Ni content of the metal material used as the base material of the ground electrode was 90 mass % or more, the thickness of the oxidation film was very large when no coating layer was formed on the ground electrode. In these samples, the ground electrode was insufficient in oxidation resistance. By contrast, the thickness of the oxidation film was significantly small when the coating layer was formed on the ground electrode. The ground electrode had high oxidation resistance in these samples. Namely, it was very effective to form the coating layer on the ground electrode for improvement in oxidation resistance when the spark plug had the tendency that the oxidation resistance of the ground electrode became insufficient by the use of the metal material containing 90 mass % of Ni as the base material of the ground electrode.

It has been shown by the above test results that the formation of the coating layer is particularly effective in the spark plug where the ground electrode has a fear of deterioration in oxidation resistance due to the use of the metal containing 90 mass % or more of Ni as the base material.

Figure 9:
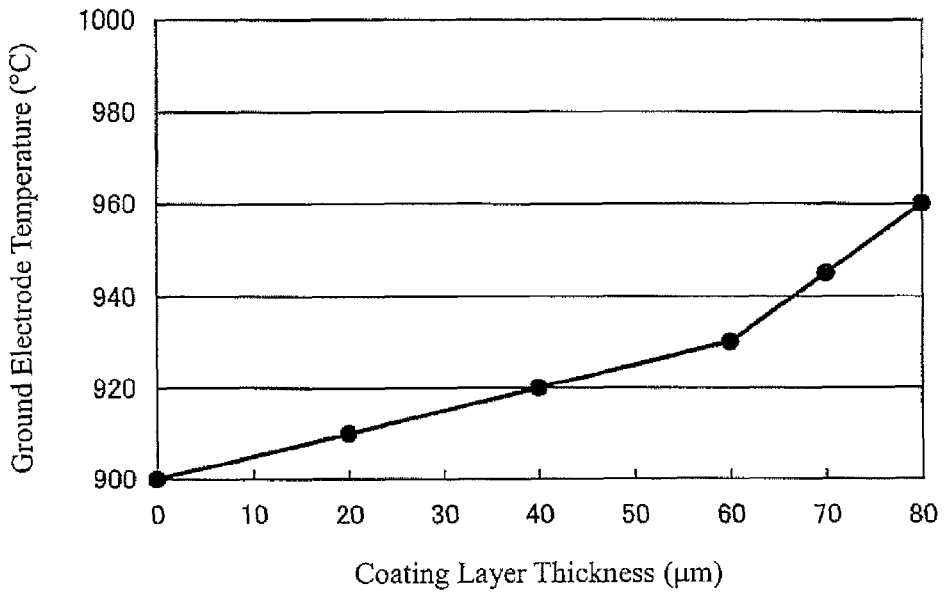
FIG. 9 is a graph showing the results of temperature measurement tests during heating of spark plug samples prepared by varying the thickness of the coating layer.

Moreover, spark plug samples were prepared by forming coating layers with various thicknesses only on respective electrode distal end portions and bent portions of ground electrodes. The thus-obtained spark plug samples were subjected to desk burner test and temperature measurement test during heating in the same manner as above except that the number of heating and cooling cycles in the desk burner test was changed from 3000 to 5000. In the desk burner test, the oxidation resistance was evaluated as: "◎" meaning very high when the thickness of the oxidation film was 0.1 mm or smaller; "○" meaning high when the thickness of the oxidation film was larger than 0.1 mm and smaller than or equal to 0.2 mm; and "Δ" meaning slightly low when the thickness of the oxidation film was larger than 0.2 mm. TABLE 1 shows the results of the desk burner test of the spark plug samples. FIG. 9 shows the results of the temperature measurement test during heating of the spark plug samples.

In each sample, the protrusion length L of the ground electrode was set to 7.6 mm; the base material of the ground electrode was a metal material having a Ni content of 90 mass % or more; and the thickness of the coating layer was adjusted by changing the spraying time during the formation of the coating layer.

TABLE 1

| | Thickness (μm) of coating layer | | | | | | | | | |
|---|---|---|---|---|---|---|---|---|---|---|
| | 3 | 5 | 10 | 15 | 20 | 40 | 50 | 60 | 70 | 80 |
| Oxidation resistance | Δ | ○ | ○ | ◎ | ◎ | ◎ | ◎ | ◎ | ◎ | ◎ |

As seen from TABLE 1, the ground electrode had good oxidation resistance in each of the spark plug samples in which the thickness of the coating layer was 5 μm or larger. The reason for this is assumed that the sufficient thickness of the coating layer was secured to effectively prevent contact of oxygen with the ground electrode.

In particular, the ground electrode had very good oxidation resistance in each of the spark plug samples in which the thickness of the coating layer was 15 μm or larger.

As seen from FIG. 9, the ground electrode was effectively prevented from temperature rise during heating in each of the spark plug samples in which the thickness of the coating layer was 60 μm or smaller. The reason for this is assumed that it was easier to radiate heat from the part of the ground electrode covered with the coating layer.

It has been confirmed by the above test results that it is preferable to set the thickness of the coating layer to 5 to 60 μm for the purpose of further improving not only the oxidation resistance of the ground electrode but also the overheating prevention effect of the ground electrode.

It has also been confirmed that it is more preferable to set the thickness of the coating layer to 15 μm or larger for the purpose of further improving the oxidation resistance of the ground electrode.

Furthermore, spark plug samples were each prepared by providing a base material (with a nickel content of 90 mass %) of the ground electrode 27 and optionally applying a coating layer 31 with a thickness of 30 mm onto an electrode distal end portion 273 of the ground electrode 27 by high velocity oxygen fuel (HVOF) spraying.

In each sample, the coating layer 31 was applied to a distal end face 27F, a back surface 27B and side surfaces 27S 1 and 27S2 of the electrode distal end portion and was not applied to a facing surface 27A of the electrode distal end portion.

In the spark plug sample of sample type A, the coating layer was of a material containing Ni, Co and Cr. In the spark plug sample of sample type B, the coating layer was of a material containing Ni, Co, Cr, Al and Y. In the spark plug sample of sample type C, no coating layer was applied.

The thus-obtained spark plug samples were each subjected to thermal durability test under the following test conditions.

Test Conditions

The spark plug sample was mounted to an L4 type (incylinder 4-cylinder), 2000-cc engine and tested by repeating WOT operation (1 minute) and idling operation (1 minute) of the engine at 3500 rpm for 100 hours.

After the test, the maximum thickness of an oxidation film formed on the front end face 27F of the ground electrode was measured by taking a cross section of the distal end portion of the ground electrode in each of the spark plug samples. The measurement results are as follows.

Figure 15A:
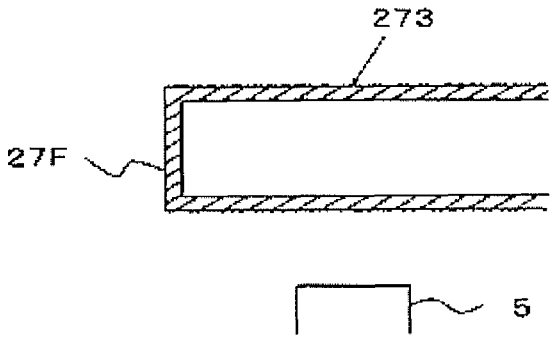
FIGS. 15(*a*) to 15(*c*) are schematic section views of electrode distal end portions of ground electrodes, which shows the thickness of oxidation films after test of spark plug samples prepared by varying the composition of the coating layer.
Figure 15B:
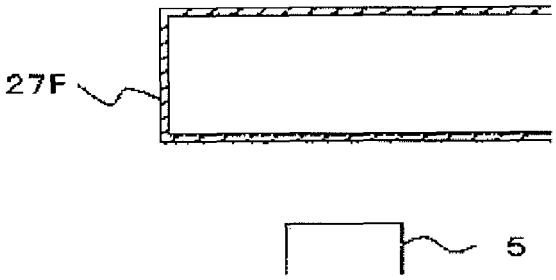
Figure 15C:
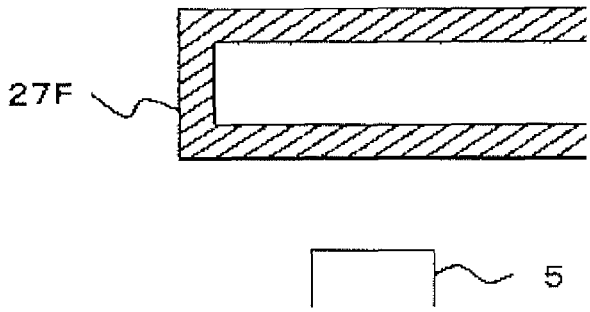

Sample type A: Oxidation film thickness 0.05 mm or larger and smaller than 0.3 mm Sample type B: Oxidation film thickness smaller than 0.05 mm Sample type C: Oxidation film thickness 0.3 mm or larger FIGS. 15(*a*), 15(*b*) and 15(*c*) are schematic section views of the electrode distal end portions of the ground electrodes in the spark plug samples of sample types A, B and C after the test, respectively.

In the spark plug sample of sample type C in which no coating layer 31 was applied, the oxidation film was formed with a thickness of 30 mm or larger by oxidation of the electrode base material.

The ground electrode had high oxidation resistance as the thickness of the oxidation film was small in each of the spark plug samples in which the coating layer was applied to the ground electrode as compared to the spark plug samples in which no coating layer was applied to the ground electrode. In particular, the ground electrode had higher oxidation resistance as the thickness of the oxidation film was significantly small in the case where the coating layer was of the material containing Ni, Co, Cr, Al and Y.

Although the present invention has been described above with reference to the specific exemplary embodiment, the present invention is not limited to the above exemplary embodiment. For example, the present invention can alternatively be embodied as mentioned below. It is needless to say that any application examples modifications other than the following examples are possible.

(a) Although the metal material containing Ni and Co etc. is used as the constitutional material of the coating layer 31 in the above embodiment, the material of the coating layer 31 is not limited to such a metal material. Any material having higher oxidation resistance than the base material of the ground electrode 27 can be used as the constitutional material of the coating layer 31.

Figure 10:
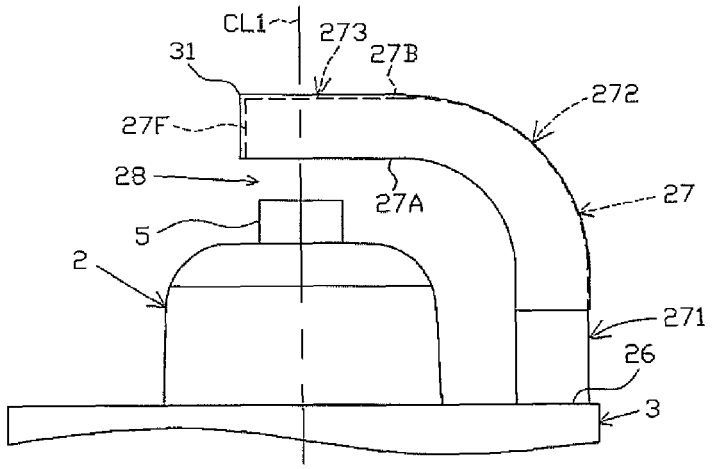
FIG. 10 is an enlarged elevation view of a coating layer of a spark plug according to another embodiment of the present invention.

(b) It suffices that the base material of the ground electrode 27 is exposed at least a part of the electrode base portion 271 although the base material of the ground electrode 27 is exposed at the entire outer surface of the electrode base portion 271 in the above embodiment. For example, it is feasible to cover a part of the electrode base portion 271 with the coating layer 31 while allowing the base material of the ground electrode 27 to be exposed at another part of the electrode base portion 271 as shown in FIG. 10.

Figure 11:
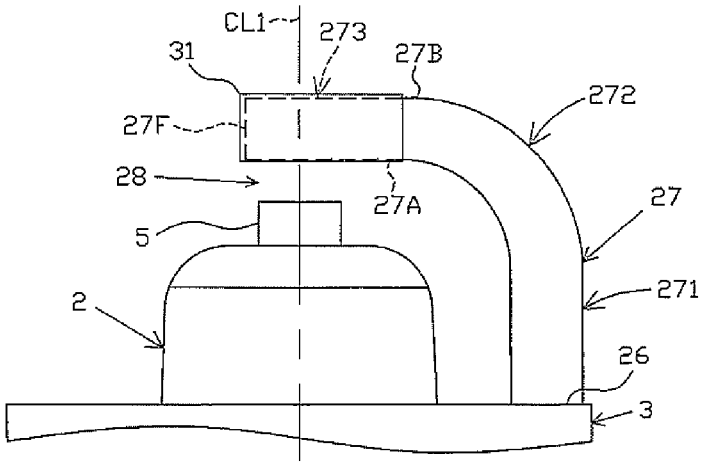
FIG. 11 is an enlarged elevation view of a coating layer of a spark plug according to still another embodiment of the present invention.
Figure 12:
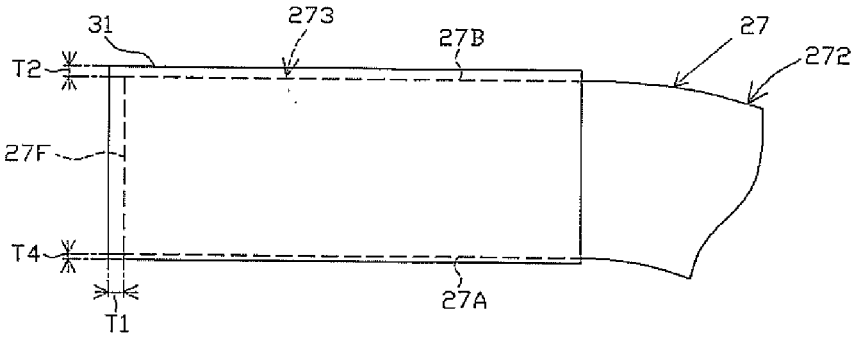
FIG. 12 is an enlarged elevation view showing the thickness of the coating layer in the spark plug according to the still another embodiment of the present invention.

(c) In the above embodiment, the coating layer 31 is applied to the front end face 27F, the back surface 27B and the side surfaces 27S 1 and 27S2 of the electrode distal end portion 273 and is not applied to the facing surface 27A of the electrode distal end portion 273. Alternatively, the coating layer 31 may also be applied to the facing surface 27A as shown in FIGS. 11 and 12. In this case, it is preferable that a minimum thickness T4 of the coating layer 31 on the facing surface 27A is set smaller than the minimum thickness T2 of the coating layer on the front end face 27F and the back surface 27B etc. By such thickness control, the spark discharge gap 28 can be assuredly prevented from significantly increasing in size even in the event of separation of the coating layer 31 from the facing surface 27A or sudden wearing of the coating layer 31 by spark discharges by spark discharges. It is thus possible to retard increase of the discharge voltage and effectively prevent sudden wearing of the ground electrode 27 and the center electrode 5.

Figure 13:
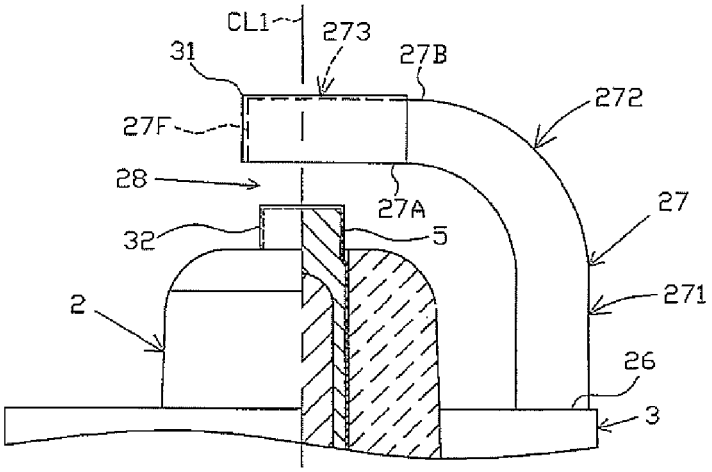
FIG. 13 is a partially cutaway elevation view of a part of a center electrode of a spark plug according to yet another embodiment of the present invention.

(d) Although the coating layer 31 is applied only to the ground electrode 27 in the above embodiment, a coating layer 32 of a metal material having higher oxidation resistance than that of the base material (outer layer 5B) of the center electrode 5 may also be applied to a surface of the center electrode 5 as shown in FIG. 13. (It is herein noted that, in FIG. 13, the coating layer 32 is shown with a larger thickness than actual for illustration purposes.) In this case, it is possible to improve the oxidation resistance of both of the ground electrode 27 and the center electrode 5.

Figure 14A:
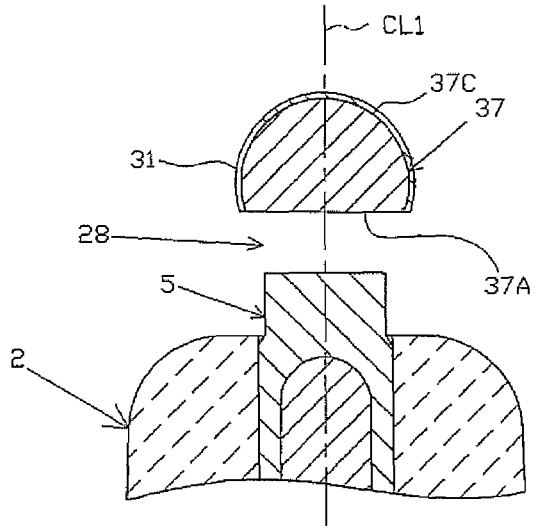
FIGS. 14(*a*) and 14(*b*) are enlarged section views of parts of ground electrodes of spark plugs according to other embodiments of the present invention.
Figure 14B:
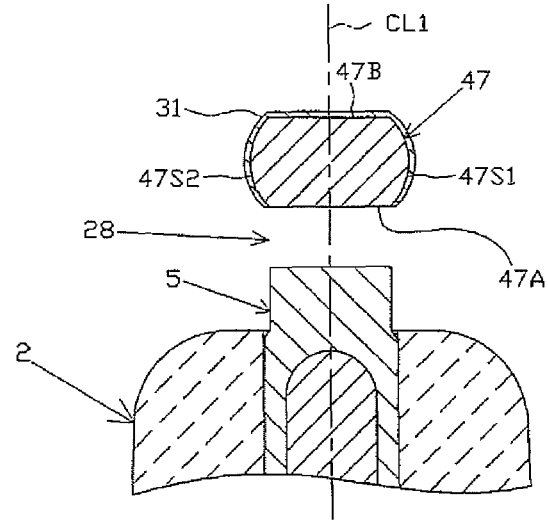

(e) Although the ground electrode 27 is rectangular in cross section in the above embodiment, there is no particular limitation on the cross sectional shape of the ground electrode 27. For example, it is feasible to provide a ground electrode 37 such that an outer circumferential surface 37C other than a facing surface 37A of the ground electrode 37 is outwardly convex curved as shown FIG. 14(*a*). It is alternatively feasible to provide a ground electrode 47 such that both of a facing surface 47A and a back surface 47B of the ground electrode 47 are flat whereas both of side surfaces 47S 1 and 47S2 of the ground electrode 47 are outwardly convex curved as shown in FIG. 14(*b*). In these cases, it is possible to facilitate flow of fuel gas to flow around the ground electrode 37, 47 into the spark discharge gap 28 for improvement in ignition performance when the spark plug 1 is mounted to the internal combustion engine etc. in such a manner that the ground electrode 37, 47 is situated between the spark discharge gap 28 and a fuel injector.

(f) In the above embodiment, the ground electrode 27 is joined to the front end portion 26 of the metal shell 3. Alternatively, the ground electrode may be formed by cutting a part of the metal shell (or a part of a front-end metal member previously joined to the metal shell) (see, for example, Japanese Laid-Open Patent Publication No. 2006-236906).

(g) Although the tool engagement portion 19 is hexagonal in cross section in the above embodiment, the shape of the tool engagement portion 19 is not limited to such a hexagonal cross-sectional shape. The tool engagement portion 19 may alternatively be formed into a Bi-HEX shape (modified dodecagonal shape) (according to ISO 22977: 2005(E)) or the like.

DESCRIPTION OF REFERENCE NUMERALS

1: Spark plug
2: Ceramic insulator (Insulator)
3: Metal shell
4: Axial hole
5: Center electrode
27: Ground electrode
27A: Facing surface (of ground electrode)
27B: Back surface (of ground electrode)
27F: Distal end face (of ground electrode)
27S1, 27S2: Side surface (of ground electrode)
28: Spark discharge gap (Gap)
31: Coating layer
271: Electrode base portion
272: Bent portion
273: Electrode distal end portion
CL1: Axis Having described the invention, the following is claimed:

1. A spark plug, comprising:

a cylindrical insulator having an axial hole formed therethrough in an axis direction of the spark plug;

a center electrode inserted in a front side of the axial hole;

a cylindrical metal shell arranged on an outer circumference of the insulator;

a ground electrode comprised of a base material, said ground electrode having a first end joined to a front end portion of the metal shell and a free end forming a gap with the center electrode, said ground electrode having an electrode base portion, a curved bent portion and an electrode distal end portion, the electrode base portion being joined to the front end portion of the metal shell and extending from the front end portion of the metal shell toward a front end of the spark plug in the axis direction; the curved bent portion being connected at one end thereof to the electrode base portion and connected at another end to the electrode distal end portion, said electrode distal end portion extending from the bent portion in a direction different from the direction of the electrode base portion, said distal end portion having a distal end face at the free end of said ground electrode, and forming the gap with the center electrode, a coating layer applied to the base material of said ground electrode, said coating layer made of a material having higher oxidation resistance than that of the base material, said coating layer applied to the face end of the ground electrode so as to cover the distal end face and an outer circumferential surface of said ground electrode except a surface of the electrode distal end portion facing the center electrode; and wherein at least a part of the base material of the electrode base portion of the ground electrode is not covered by said coating layer.

2. The spark plug according to claim 1, wherein the base material of the ground electrode is exposed at the entire outer surface of the electrode base portion.

3. The spark plug according to claim 1, wherein the coating layer is formed only on the electrode distal end portion; and wherein the base material of the ground electrode is exposed at the bent portion.

4. The spark plug according to claim 1, wherein the base material of the ground electrode is a metal material containing 90 mass % or more of nickel (Ni).

5. The spark plug according to claim 1, wherein the coating layer has a thickness of 5 to 60 μm.

6. The spark plug according to claim 1, wherein the coating layer is formed only on the electrode distal end portion, or is formed on the electrode distal end portion and the bent portion in such a manner that a minimum thickness of the coating layer on the electrode distal end portion is larger than a minimum thickness of the coating layer on the bent portion.

7. The spark plug according to claim 1, wherein a minimum thickness of the coating layer on the distal end face of the electrode distal end portion is larger than a minimum thickness of the coating layer on the outer circumferential surface other than the center-electrode-side surface of the electrode distal end portion.

8. The spark plug according to claim 1, wherein the coating layer is formed only on the distal end face and the outer circumferential surface other than the center-electrode-side surface of the electrode distal end portion, or is formed on the entire outer surface of the electrode distal end portion in such a manner that a minimum thickness of the coating layer on the center-electrode-side surface of the electrode distal end portion is smaller than a minimum thickness of the coating layer on the distal end face and the outer circumferential surface other than the center-electrode-side surface of the electrode distal end portion.

9. The spark plug according to claim 1, wherein the material of the coating layer is a material containing Ni, cobalt (Co) and chromium (Cr).

10. The spark plug according to claim 9, wherein the material of the coating layer further contains yttrium (Y) and aluminum (Al).

11. The spark plug according to claim 1, wherein the coating layer is formed by high velocity oxygen fuel (HVOF) spraying, high velocity air fuel (HVAF) spraying, plasma spraying, cold spraying or aerosol deposition.

* * * * *